United States Patent [19]

Eberly, Jr.

[11] 4,183,218

[45] Jan. 15, 1980

[54] THERMAL POWERED GAS GENERATOR

[76] Inventor: David H. Eberly, Jr., 2303 Congress St., Fairfield, Conn. 06430

[21] Appl. No.: 758,334

[22] Filed: Jan. 10, 1977

[51] Int. Cl.[2] ..... F01K 25/06

[52] U.S. Cl. ..... 60/673

[58] Field of Search ..... 60/648, 649, 673

[56] References Cited

U.S. PATENT DOCUMENTS

| | | | |
|---|---|---|---|
| 337,371 | 3/1886 | Campbell | 60/649 |
| 427,400 | 5/1890 | Campbell | 60/673 |
| 427,401 | 5/1890 | Campbell | 60/673 |
| 1,145,866 | 7/1915 | Miller | 137/11 |
| 2,011,626 | 8/1935 | Goff | 137/11 |

FOREIGN PATENT DOCUMENTS

| | | | |
|---|---|---|---|
| 294882 | 9/1929 | United Kingdom | 60/673 |

*Primary Examiner*—Allen M. Ostrager
*Attorney, Agent, or Firm*—Cushman, Darby & Cushman

[57] ABSTRACT

A method and system for converting thermal energy into mechanical energy and producing a flow of pressurized gas in a closed loop with a gas pressurizing unit, a heat storage unit, a cooling unit and a gas absorption unit. The gas pressurizing unit includes a tank in which a mother liquor such as a mixture of ammonia and water is vaporized to produce the pressurized gas flow. The pressure in the tank pumps the mother liquor up against gravity through a second heat storage tank which is part of the heat storage unit and to the cooling unit where the liquor is injected into a third cooled tank forming a part thereof. From the third tank the liquor flows through a microporous tube in a fourth tank forming part of the gas absorption unit where the liquor absorbs spent gas which is supplied thereto. A one way check valve between the fourth and second tanks permits the mother liquor in the fourth tank to flow by gravity, via the second tank where it is preheated, back into the first tank when the pressure in the first tank drops below a preset value and the above cycle is repeated.

19 Claims, 4 Drawing Figures

THERMAL POWERED GAS GENERATOR

FIELD OF THE INVENTION

The invention relates to an apparatus for converting thermal energy into mechanical energy and particularly to a method and system for producing a flow of pressurized gas in a closed system.

BACKGROUND OF THE INVENTION

Each day the Earth is flooded with thermal energy from the sun far beyond what mankind can utilize. Further thermal energy is a by-product of many human activities. The greatest challenge of mankind today is to harvest even a tiny portion of this energy efficiently and economically.

One of the greatest problems in using thermal energy is the difficulty of storing and transporting thermal energy. To be practically used, thermal energy must be converted to mechanical energy which is then used to produce electricity. Another problem is that the thermal energy produced by solar generators is at relatively low temperatures, typically below the boiling point of water.

The present invention relates to a simple, unique and practical system for converting thermal energy in a hot water flow at a relatively low temperature to pressurized gas at a relatively high pressure which can then be use to generate electricity. The unit has only one moving and operates at relatively high efficiency and reliability.

SUMMARY OF THE INVENTION

Figure 1:
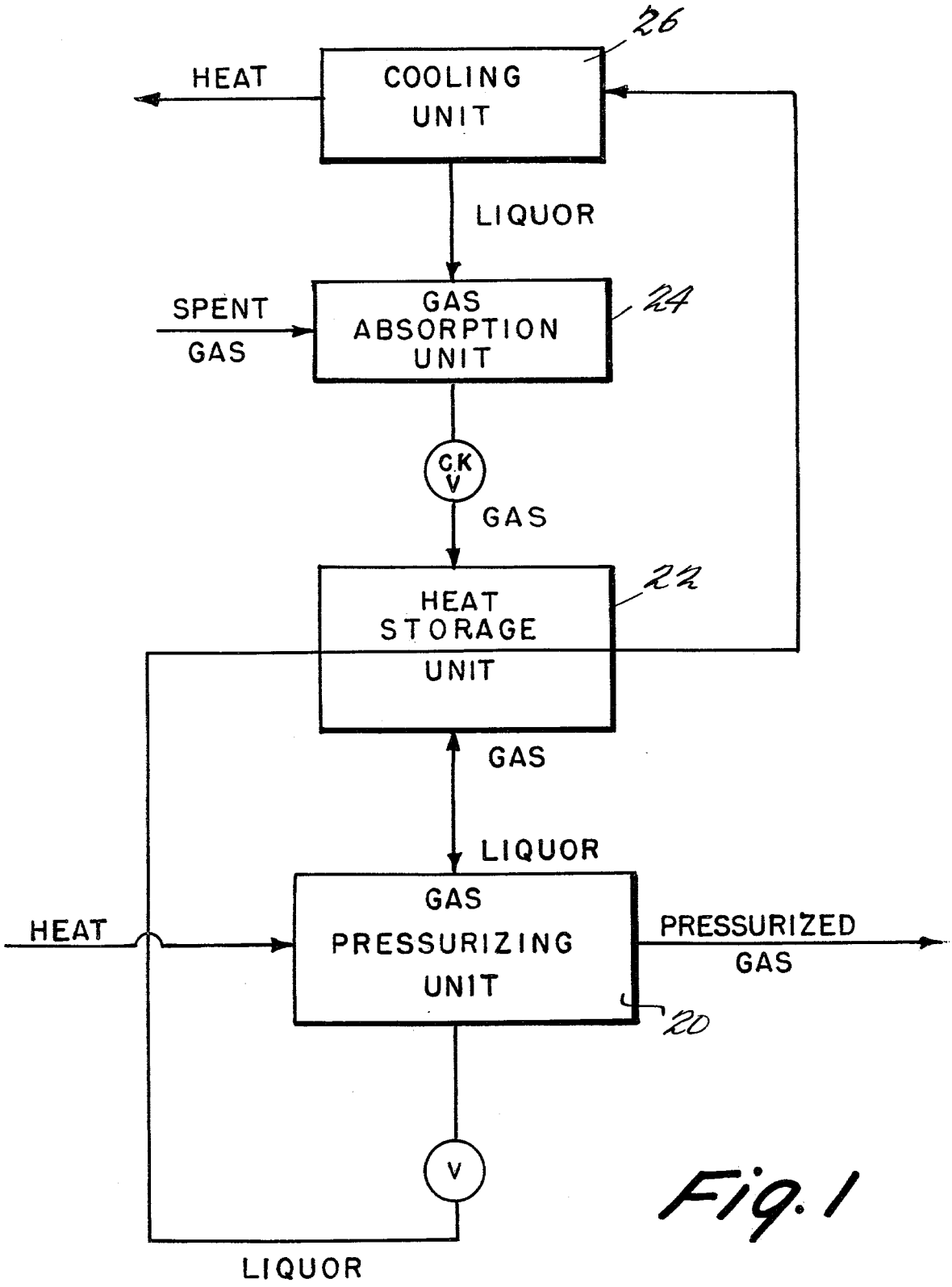
FIG. 1 shows a block diagram of one embodiment of the present invention.

Reference is now made to FIG. 1 which illustrates a block diagram of one embodiment of the present invention. According to this embodiment, the system operates in a continuous cycle in which pressurized gas is produced from mother liquor in a gas pressurizing unit 20 until the motor liquor is depleted and the pressure drops. At this time, unit 20 is flooded with mother liquor which is then evaporated to produce a pressurized gas flow. More particularly, heat, e.g., generated by solar or other sources as described in greater detail below, is supplied to gas pressurizing unit 20 to evaporate mother liquor therein, preferably, a mixture of water and ammonia. An aqua-ammonia mixture is very heat responsive in the 50°-150° F. range which is a suitable range for hot water from solar panels. The evaporated gas collects in the top of the unit 20 and provides a flow of pressurized gas, e.g., to an electric generator of the type described in the co-pending application Ser. No. 738,759 by the applicant herein filed on Nov. 4, 1976. The gas pressure produced by evaporation of the gas also forces the mother liquor in the bottom of unit 20 through a control valve and through a heat storage unit 22 where the mother liquor serves to preheat mother liquor with absorbed spent gas which is flowing through heat storage unit 22 as will be apparent from the discussion below.

After passage through heat storage unit 22, without intermingling with the gas or mother liquor therein, the mother liquor, from unit 20, cooled by passage through a heat exchanger in heat storage unit 22, is sprayed into a cooling unit 26 by a suitable nozzle. Further cooling takes place in unit 26. The mother liquor then moves into a gas absorbtion unit 24, where it moves through a microporous tube and absorbs spent gas supplied to unit 24, e.g., from the electrical generator as described in the above patent application, Ser. No. 738,759. Gas pressurizing unit 20 is also connected directly to the heat storage unit 22, so that the gas produced by evaporation of the mother liquor also collects within heat storage unit 22. As the mother liquor within unit 20 is depleted by evaporation, the pressure of the gas within that unit and within unit 22 drops until it is less than the pressure produced by the mother liquor in unit 24 by gravity at which time the mother liquor in unit 24 flows through the ball float valve which serves as a check valve, through the heat storage unit 22, where it is heated, and into the gas pressurizing unit 20 to flood that unit with mother liquor. The mother liquor thus added is then heated within unit 20 and evaporates to begin the cycle anew.

Many other objects and purposes of the invention will be clear from the following detailed description of the invention.

DETAILED DESCRIPTION OF THE INVENTION

Figure 2:
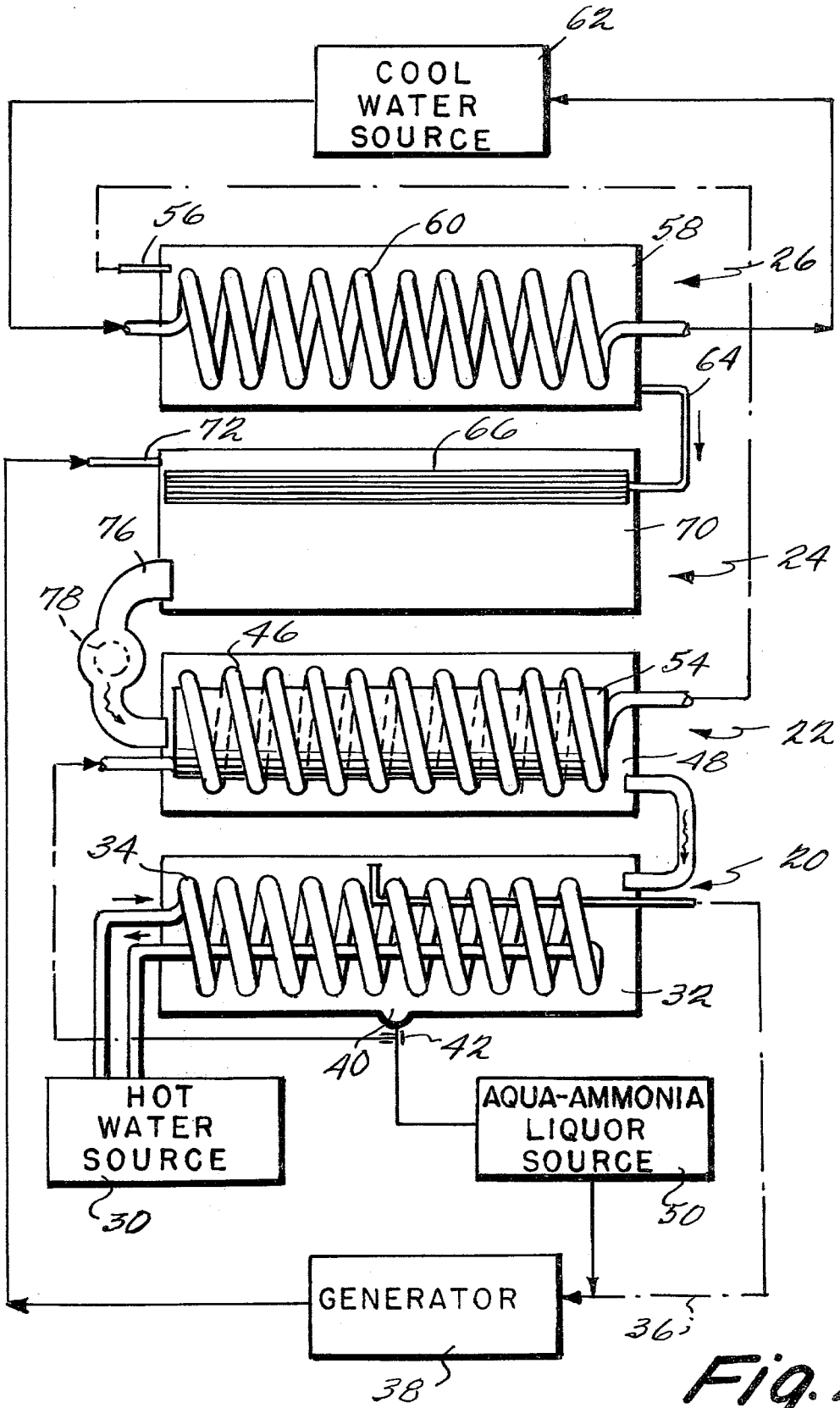
FIG. 2 shows a detailed schematic of the block diagram of FIG. 1.

Reference is now made to FIG. 2 which illustrates the embodiment of FIG. 1 in greater detail. In the arrangement of FIG. 2, heat is supplied to the system from a hot water source 30 and flows through the tank 32 which comprises unit 20 in a conventional heat exchange coil 34. Source 30, for example, may be a solar panel or waste water from a industrial source. The gas which evaporates as a result of the heat added to the mother liquor within tank 32 by the flowing hot water collects at the top of tank 32 and leaves via outlet 36 which is connected to an electric generator 38 or the like as described in the above-mentioned patent application Ser. No. 738,759. The pressure in tank 32 produced by the evaporation of the mother liquor forces the mother liquor in the bottom of tank 32 through the collecting sump 40 and the orifice valve 42 to the input to heat exchange coil 46 in the tank 48 comprising unit 22 and to an aqua-ammonia liquor source 50. Source 50 supplies a small quantity of mother liquor to generator 38 as may be needed to assist in proper operation. Coil 46 surrounds a finned, open ended, iron sleeve 54 through which the mother liquor flows during replenishment of tank 32 as described in greater detail below. The heated mother liquor flowing through coil 46 in tank 48 operates to preheat the mother liquor which floods the tank 32 as described below.

The outlet of coil 46 is connected to a conventional nozzle 56 which injects the cooled mother liquor into a tank 58 which forms part of unit 26. Water, at a temperature below the temperature of the water flowing through coil 34, flows through heat exchange coil 60 within tank 58 from a suitable cold water source 62 to further cool the mother liquor which then flows from an outlet of tank 58 through line 64 into a microporous tube 66. The spent gas from generator 38 is supplied to the tank 70 via nozzle 72 and as the gas flows over the microporous tube it is absorbed into the cooled mother liquor which then collects as a cooled strong liquid in the bottom of tank 70.

The outlet of tank 70 is connected to tank 48 via line 76 in which a conventional ball float check valve 78 is disposed. The interior of tank 48 is also connected to the top of the tank 32 so that the pressurized gas produced by evaporation of the mother liquor flows into tank 48 and holds the check valve 78 in its closed position. However, when the mother liquor has been substantially forced from tank 32, the pressure within tank 32 begins to drop, and when it has dropped to a point in which replenishment of the mother liquor is desirable, the check valve 78 opens to permit the mother liquor to flow through the finned iron sleeve 54 where it is preheated by the mother liquor flowing through coil 46. After passage through sleeve 54, the mother liquor floods into the tank 32 to replenish the supply therein, and the above cycle is repeated.

The pressure at outlet 36 will, of course, drop during flooding and continue until substantial evaporation has occurred. If this intermittent drop is a problem, a pressure reservoir can be inserted.

Figure 3:
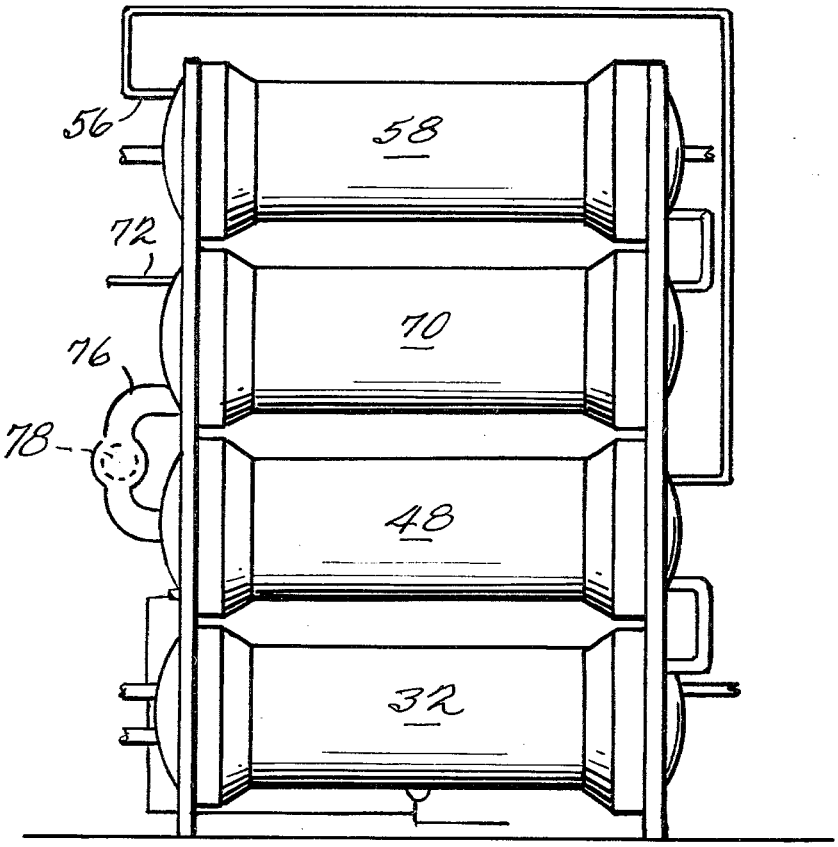
FIG. 3 shows a side view of an assembled system according to the embodiment of FIGS. 1 and 2.
Figure 4:
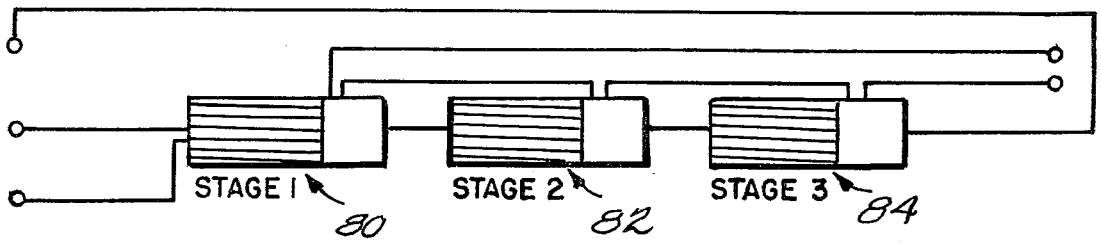
FIG. 4 shows a schematic view of a system including a plurality of stages.

Reference is now made to FIG. 3, which illustrates a practical arrangement of tanks 32, 48, 70 and 58, one about the other, to carry out the functions described above. The tanks are preferably insulated to increase efficiency.

FIG. 3 shows a connection of a number of individual generators 80, 82 and 84 arranged in series in order so that the pressurized gas passes through each stage in turn with each stage extracting energy until the gas is spent.

Many changes and modifications in the above described embodiment of the invention can, of course, be carried out without departing from the scope thereof. Accordingly, that scope is intended to be limited only by the scope of the appended claims.

What is claimed is:

1. A system for converting thermal energy into mechanical energy in a flow of pressurized gas comprising:

a gas pressurizing unit including a first tank for holding a quantity of a mother liquor, means for supplying heat to said liquor in said first tank to cause evaporation of said gas, mother liquor inlet means for receiving mother liquor, outlet means for removing the pressurized gas produced by said evaporation, the liquor outlet means for removing mother liquor forced from said first tank by the pressurized gas produced therein;

a gas absorbing unit including a second tank connected to said liquor outlet means of said first tank for receiving mother liquor from said first tank, an inlet means for receiving spent gas so that the spent gas is absorbed by the mother liquor and an outlet means for the mother liquor with absorbed gas, and means for connecting said second tank outlet to said mother liquor inlet means including valve means for permitting mother liquor in said second tank to flow by gravity into said first tank when the pressure of gas in said first tank falls below a predetermined value and for preventing liquor from flowing into said first tank when the pressure in said first tank is above said predetermined value.

2. A system as in claim 1, further including a heat storage unit comprising a third tank having an inlet connected to said valve means for receiving mother liquor from said second tank, an outlet connected to said inlet means of said first tank, and means extending through said third tank and connected to said mother liquor outlet for carrying mother liquor from said mother liquor outlet means so as to transfer heat to the mother liquor entering said third tank from said inlet thereof and further including a cooling unit comprising a fourth tank having an inlet connected for said carrying means for receiving mother liquor therefrom, means in said fourth tank for cooling the mother liquor therein and an outlet connected to said inlet means of said second tank.

3. A system as in claim 2, wherein said carrying means includes a coil.

4. A system as in claim 3, wherein said heat storage unit includes a finned iron sleeve having open ends and arranged so that mother liquor entering said third tank from said valve means flows therethrough and with said coil disposed about said sleeve.

5. A system as in claim 2, wherein said heat supplying means includes a heating coil within said first tank and means for supplying hot water to said heating coil and wherein said cooling means includes a cooling coil within said fourth tank and means for supplying cool water to said cooling coil.

6. A system as in claim 2, including a nozzle for spraying mother liquor into said third tank.

7. A system as in claim 2, wherein said valve means includes a float valve.

8. A system as in claim 2, wherein said tanks are disposed vertically one above another with the fourth tank highest, the second tank below the fourth tank, the third tank below the fourth tank and the first tank lowermost.

9. A system as in claim 1, further including a microporous tube within said second tank for receiving mother liquor from said inlet means so that said spent gas is absorbed into said mother liquor.

10. A system for converting thermal energy into mechanical energy in a flow of pressurized gas comprising:

a gas pressurizing means for evaporating mother liquor to produce said flow from a first outlet and to pump mother liquor from a second outlet;

a heat storage means connected to said gas pressurizing means for supplying mother liquor in said heat storage means to said gas pressurizing means, and through which mother liquor from said gas pressurizing unit is pumped to transfer heat;

a cooling means connected to said second outlet for receiving and cooling mother liquor pumped from said gas pressurizing means, and having a third outlet;

a gas absorbtion means connected to said third outlet for receiving cooled mother liquor and having an inlet for receiving gas at a pressure below the pressure at said first outlet so that the cooled mother liquor absorbs the gas; and valve means connecting said gas absorbtion means and said heat storage means so that mother liquor flows by gravity from said gas absorbtion means into said heat storage means and then into said pressurizing means only when the pressure in said pressurizing means falls below a given value.

11. A system as in claim 10, wherein said gas absorbtion means includes a microporous tube through said mother liquor flows.

12. A system as in claim 10, wherein said pressurizing means includes a coil through which a hot liquid is circulated to transfer heat to and evaporate said mother liquor.

13. A system as in claim 10, wherein said valve means includes a ball-float valve.

14. A system as in claim 10, wherein each of said gas pressurizing, heat storage, cooling and gas absorbtion means includes a tank.

15. A system as in claim 14, wherein said tanks are disposed vertically, one above the other with the cooling tank uppermost, the gas absorbtion tank next lowest, the heat storage tank next lowest and the gas pressurizing tank lowermost.

16. A method of converting thermal energy into mechanical energy in a pressurized gas flow comprising the steps of:

heating mother liquor in a first tank to evaporate said liquor to produce said gas and pump mother liquor into a second tank;

removing the evaporated gas to produce said pressurized gas flow;

causing mother liquor to flow from said first tank into a second tank;

supplying spent gas to said second tank so that the spent gas is mixed with the mother liquor; and causing the mother liquor in said second tank to flow by gravity into said first tank when the pressure in said first tank drops below a predetermined value, while preventing flow when the pressure is above said predetermined pressure.

17. A method as in claim 16, including the further steps of passing the mother liquor pumped from said first tank through a third tank which also connects said first tank to said second tank so as to transfer heat to the mother liquor which flow from said second tank to said first tank via said third tank and cooling in a fourth tank mother liquor after passage through said third tank.

18. A method as in claim 17 wherein said step of heating includes circulating hot water through a coil in said first tank and said step of cooling includes circulating cool water through a coil in said fourth tank.

19. A method as in claim 16 including the step of causing the mother liquor entering said second tank to flow through a microporous tube.

* * * * *